US012595099B2

(12) United States Patent
Meyers et al.

(10) Patent No.: US 12,595,099 B2
(45) Date of Patent: Apr. 7, 2026

(54) BEVERAGE CONTAINER LID WITH MAGNETIC SEALING MECHANISM

(71) Applicant: Runway Blue, LLC, Lehi, UT (US)

(72) Inventors: David O. Meyers, Layton, UT (US); Paul James Faerber, Orem, UT (US); Quincy A. Kesti, Lehi, UT (US)

(73) Assignee: Runway Blue, LLC, Lehi, UT (US)

( * ) Notice: Subject to any disclaimer, the term of this patent is extended or adjusted under 35 U.S.C. 154(b) by 249 days.

(21) Appl. No.: 18/360,531

(22) Filed: Jul. 27, 2023

(65) Prior Publication Data

US 2025/0033843 A1 Jan. 30, 2025

(51) Int. Cl.

| | |
|---|---|
| ***B65D 47/28*** | (2006.01) |
| ***B65D 43/02*** | (2006.01) |
| ***B65D 47/32*** | (2006.01) |

(52) U.S. Cl.

CPC ..... *B65D 47/286* (2013.01); *B65D 43/0229* (2013.01); *B65D 47/32* (2013.01); *B65D 2205/02* (2013.01); *B65D 2543/00046* (2013.01); *B65D 2543/00092* (2013.01)

(58) Field of Classification Search

CPC .. B65D 47/286; B65D 43/0229; B65D 47/32; B65D 2205/02; B65D 2543/00046; B65D 2543/00092; B65D 2313/04; B65D 47/249; B65D 51/1683; A47G 19/2272

See application file for complete search history.

(56) References Cited

U.S. PATENT DOCUMENTS

| | | | |
|---|---|---|---|
| 6,390,319 | B1 | 5/2002 | Yu |
| 7,950,541 | B2 | 5/2011 | Holcomb et al. |
| 7,997,442 | B2 | 8/2011 | Pinelli |
| 8,590,731 | B2 | 11/2013 | Pinelli |
| 8,613,369 | B2 | 12/2013 | Kitto |
| 8,960,490 | B2 | 2/2015 | Carlile et al. |
| 9,889,972 | B2 | 2/2018 | Sugai |
| 9,908,687 | B2 | 3/2018 | Chiou et al. |
| 9,913,552 | B2 | 3/2018 | Elsaden et al. |

(Continued)

FOREIGN PATENT DOCUMENTS

| | | |
|---|---|---|
| CN | 213786646 U | 7/2021 |

OTHER PUBLICATIONS

International Search Report and Written Opinion for PCT/US2024/038808, mailed on Nov. 4, 2024, 12 pages.

*Primary Examiner* — Frederick C Nicolas
*Assistant Examiner* — Michael J. Melaragno
(74) *Attorney, Agent, or Firm* — Sterne, Kessler, Goldstein & Fox P.L.L.C.

(57) ABSTRACT

A lid for a container including a lid body, a movable arm, a first magnet unit coupled to the movable arm, an actuator, and a second magnet unit coupled to the actuator. The actuator is movable between a first and second position. The movable arm is movable between a sealing position, in which a drinking opening of the lid body is sealed, and an open position, in which the drinking opening is not sealed. When the actuator is in the first position, at least one of a biasing force and an attractive magnetic force between the first and second magnet units hold the movable arm in the sealing position. When the actuator is moved toward the second position, a repulsive magnetic force between the first and second magnet units causes the movable arm to move toward the open position.

30 Claims, 8 Drawing Sheets

(56) References Cited

U.S. PATENT DOCUMENTS

| | | | | |
|---|---|---|---|---|
| 10,023,366 | B2 | 7/2018 | Gilbert et al. | |
| 10,093,460 | B2 | 10/2018 | Seiders et al. | |
| 10,232,993 | B2 | 3/2019 | Seiders et al. | |
| 10,259,620 | B2 * | 4/2019 | Matthis | B65D 47/0866 |
| 10,364,071 | B1 | 7/2019 | Wasso, Jr. | |
| 10,421,587 | B2 | 9/2019 | Gilbert et al. | |
| 10,689,166 | B1 | 6/2020 | Cheng | |
| 10,709,270 | B2 | 7/2020 | Joseph et al. | |
| 10,829,275 | B2 | 11/2020 | Owusu | |
| 11,560,263 | B2 | 1/2023 | Wilson | |
| 12,286,272 | B2 * | 4/2025 | Meyers | B65D 47/065 |
| 2017/0066573 | A1 | 3/2017 | Karussi et al. | |
| 2018/0127165 | A1 | 5/2018 | Smaldone et al. | |
| 2020/0055645 | A1 | 2/2020 | Lane | |
| 2020/0198851 | A1 | 6/2020 | Cheng | |
| 2022/0087454 | A1 | 3/2022 | Meyers et al. | |
| 2024/0067417 | A1 | 2/2024 | Meyers et al. | |
| 2025/0033843 | A1 * | 1/2025 | Meyers | A47G 19/2272 |

* cited by examiner

BEVERAGE CONTAINER LID WITH MAGNETIC SEALING MECHANISM

FIELD

This disclosure generally relates to containers for beverages. More specifically, some embodiments relate to beverage container lids with sealing mechanisms.

BACKGROUND

It may be desirable for a beverage container to have a sealed position, in which a drinking opening of the beverage container is sealed, and an open position, in which the drinking opening is not sealed.

SUMMARY

Some embodiments disclosed herein are directed to a lid for a container including a lid body, a movable arm, a first magnet unit coupled to the movable arm, an actuator accessible from an exterior of the lid body, and a second magnet unit coupled to the actuator. The lid body may define a drinking opening therethrough. The movable arm may be coupled to the lid body and located in an interior of the lid body. The movable arm may be movable between a sealing position, in which the drinking opening is sealed, and an open position, in which the drinking opening is not sealed. The actuator may be movable between a first position and a second position. When the actuator is in the first position, at least one of a the biasing force and an attractive magnetic force between the first magnet unit and the second magnet unit may hold the movable arm in the sealing position. When the actuator is moved toward the second position, a repulsive magnetic force between the first magnet unit and the second magnet unit may cause the movable arm to move toward the open position.

Some embodiments disclosed herein are directed to a lid for a container including a lid body, a movable arm, a first magnet unit coupled to the movable arm, an actuator accessible from an exterior of the lid body, and a second magnet unit coupled to the actuator. The lid body may define a drinking opening and a venting opening therethrough. The movable arm may be coupled to the lid body and located in an interior of the lid body. The movable arm may be movable between a sealing position, a venting position, and an open position. The actuator may be movable between a first position and a second position. When the movable arm is in the sealing position, the venting opening and the drinking opening may be sealed. When the movable arm is in the venting position, the venting opening may not be sealed and the drinking opening may be sealed. When the movable arm is in the open position, the venting opening and the drinking opening may not sealed. In response to the actuator moving from the first position to the second position, a magnetic force between the first magnet unit and the second magnet unit may move the movable arm from the sealing position to the venting position and then to the open position.

Some embodiments disclosed herein are directed to a lid for a container including a lid body, a movable arm, a first magnet unit coupled to the movable arm, an actuator accessible from an exterior of the lid body, and a second magnet unit coupled to the actuator. The lid body may define a drinking opening therethrough. The movable arm may be coupled to the lid body and located in an interior of the lid body. The movable arm may be movable between a sealing position, in which the drinking opening is sealed, and an open position, in which the drinking opening is not sealed. The actuator may be linearly slidable along a travel axis from a first position to a second position. When the actuator is moved toward the second position, a force between the first magnet unit and the second magnet unit may cause the movable arm to move away from the sealing position. At least one of the first magnet unit and the second magnet unit may be angled relative to the travel axis.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
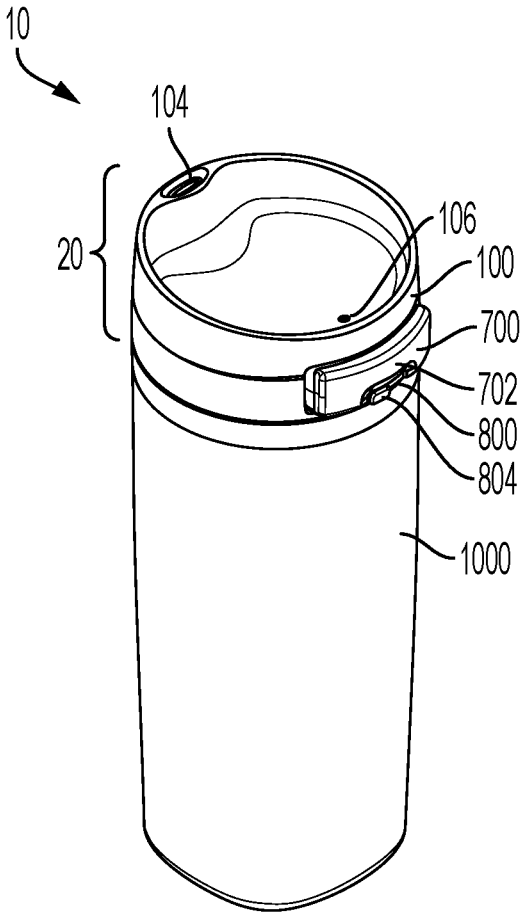
FIG. 1 shows an upper rear perspective view of a container.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, components, and elements have not been described in detail to avoid unnecessarily obscuring aspects of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, this disclosure has been prepared such that when a particular feature, structure, or characteristic is described in connection with an embodiment, it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable beverage containers to carry a variety of beverages. It is often desirable for a beverage container to have a sealing mechanism to seal a drinking opening of the beverage container when a user is not drinking from it. Sealing the drinking opening can, for example, allow a user to carry the beverage container without worrying that the beverage being carried will leak on the user or the user's belongings. Sealing the drinking opening can also, for example, allow the beverage being carried to maintain a desired temperature. Users may appreciate a beverage container that can be easily sealed and unsealed so that the user can easily drink from the beverage container.

It may also be desirable for a beverage container to have relatively few components that come into contact with a beverage contained in or consumed through the beverage container. This may be desirable, for example, so that dirt or debris on certain components does not contaminate a beverage within the beverage container or so that there are relatively few component for a user to clean (e.g., to remove beverage deposits from the components).

Some embodiments of the present disclosure provide a lid for a beverage container that can be used to easily seal and unseal a drinking opening. Several of the components are isolated from an interior volume of the container such that a beverage carried inside the container or consumed through the container does not contact the components. The lid includes a movable arm that moves in response to a magnetic force to seal and unseal a drinking opening. The lid also includes an actuator (e.g., a button) accessible from an exterior of the lid. A magnet unit is located on the movable arm, and another magnet unit is located on the actuator. In some embodiments, when the actuator is in an unpressed position, a biasing force (e.g., provided by a spring) and an attractive magnetic force between the magnet unit on the actuator and the magnet unit on the movable arm together hold the movable arm in the sealed position. When the actuator is pressed, a repulsive magnetic force between the magnet unit on the actuator and the magnet unit on the movable arm overcomes the spring force and causes the movable arm to move toward the open position.

In some embodiments, when a user releases the actuator, the actuator moves toward its original, unpressed position due to one or both of a biasing force (e.g., provided directly by a spring or other elastic element) or due to the repulsive force between the magnet unit on the actuator and the magnet unit on the movable arm. The resulting movement of the magnet unit located on the actuator reduces the magnetic force on the movable arm, thereby allowing the biasing force to return the movable arm to the sealing position.

In some embodiments, the lid includes a drinking opening and a venting opening that are separately sealed. When the actuator is pressed, the venting opening unseals before the drinking opening, which avoids or reduces venting the container through the drinking opening. In some embodiments, the movable arm contributes to this venting feature. In such embodiments, the movable arm is movable between a sealing position in which the drinking opening and venting opening are both sealed, a venting position in which the venting opening is not sealed and the drinking opening is sealed, and an open position in which both the venting opening and the drinking opening are not sealed. When the actuator is pressed, a magnetic force (e.g., a repulsive magnetic force) between the first magnet unit on the actuator and the second magnet unit on the movable arm moves the movable arm from the sealing position to the venting position and then to the open position. In some embodiments, the user does not move the actuator to change the lid from a venting mode (in which only the venting opening is not sealed) and a drinking mode (in which both the venting opening and the drinking opening are not sealed). Rather, as will be described, the lid automatically changes from the venting mode to the drinking mode while the actuator remains in the same position.

In some embodiments, the actuator slides linearly along a travel axis when moving from the unpressed position to the pressed position, and one (or both) of the magnet units is angled relative to the travel axis. Compared to a lid with similar features but no angled magnet units, a lid with an angled magnet unit creates a smoother transition of the movable arm from the sealed position to the open position. Users may prefer a smooth transition to a more sudden transition, and a smooth transition can reduce noise associated with unsealing the drinking opening or can reduce splattering of liquid from the lid from the drinking opening.

In some embodiments, the actuator may be locked so that the drinking opening is not accidently unsealed.

These and other embodiments are discussed below in more detail with reference to the figures.

Figure 2:
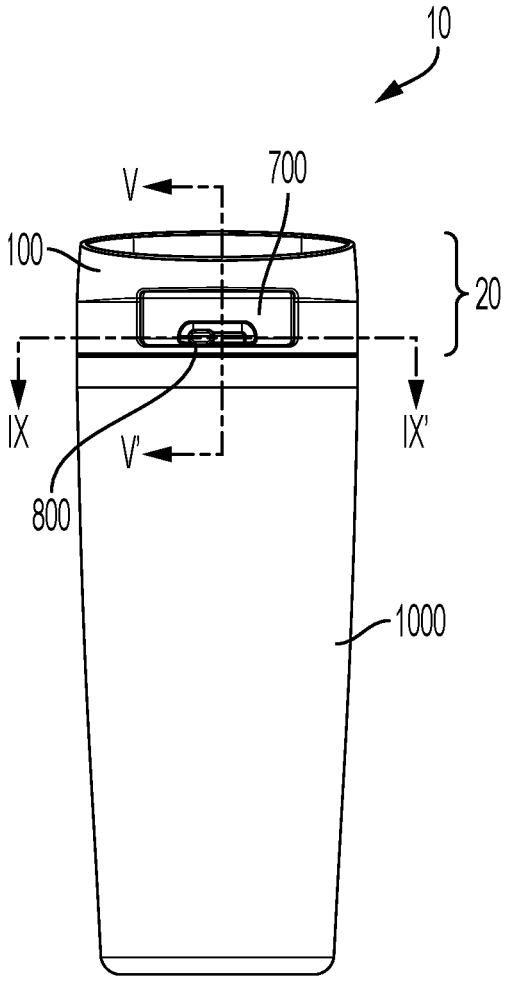
FIG. 2 shows a rear view of the container of FIG. 1.

FIGS. 1-2 show a container 10 according to some embodiments. Container 10 may include a vessel 1000 and a lid 20 for vessel 1000. Lid 20 may include multiple components, including a lid body 100 and an actuator 700. Container 10 may be, for example a container for drinking a beverage from, such as a beverage container.

Lid body 100 may include a drinking opening 104 through which a user can drink a beverage contained within vessel 1000 when lid 20 is assembled with vessel 1000. Lid body 100 may also include a vent opening 106 through which an interior volume of vessel 1000 can vent when lid 20 is assembled with vessel 1000. Lid body 100 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), or metal (e.g., steel, stainless steel, aluminum, copper, or titanium), and may be formed as a single, unitary piece.

Lid 20 when assembled with vessel 1000 can create a seal. The term seal as used here and elsewhere in this document does not necessarily require a perfect hermetic seal; rather a seal capable of inhibiting passage of liquid fluid is sufficient. Drinking opening 104 and vent opening 106 may be the only openings extending though lid body 100 to vessel 1000, and drinking opening 104 and vent opening 106 may be sealed, together or separately, in some configurations, as will be discussed in greater detail below.

Actuator 700 may be accessible from an exterior of lid body 100. Actuator 700 may be or include, for example, a button 702 (as shown in FIG. 1), a switch, a lever, or other suitable mechanical mechanism. Actuator 700 may be moveable between a first position and a second position in order to seal or unseal drinking opening 104, as will be discussed in greater detail below. Additionally or alternatively, actuator 700 may be moveable between a first position and a second position in order to seal or unseal venting opening 106.

In embodiments where actuator 700 is or includes a button 702, actuator 700 may be moveable from the first position to the second position, for example, by pressing button 702, and from the second position to the first position, for example, by releasing button 702. Actuator 700 may be formed of any suitable material (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece.

In some embodiments, lid 20 includes a locking member 800 to inhibit movement of actuator 700 and thereby inhibit opening of drinking opening 104. A user may move locking member 800 from an unlocked position to a locked position, for example, by engaging a portion of locking member 800 (e.g., nub 804) and sliding locking member 800 (e.g., in a counterclockwise direction about a locking axis 80 (see FIG. 9), viewed from the top of lid 20). When locking member 800 is in the locked position, actuator 700 is inhibited from moving from the first position to the second position to unseal drinking opening 104. When locking member 800 is in the unlocked position, actuator 700 is free to move from the first position to the second position.

In some embodiments, a user may move locking member 800 from an unlocked position or a locked position to a disassembly position, for example, by engaging a portion of locking member 800 and sliding locking member 800 (e.g., in a clockwise or counterclockwise direction about locking axis 80). When locking member 800 is in the disassembly position, actuator 700 can be removed from lid body 100.

Locking member 800 may be movable from each of its positions—e.g., unlocked position, locked position, and disassembly position—to each of its other positions.

Figure 3:
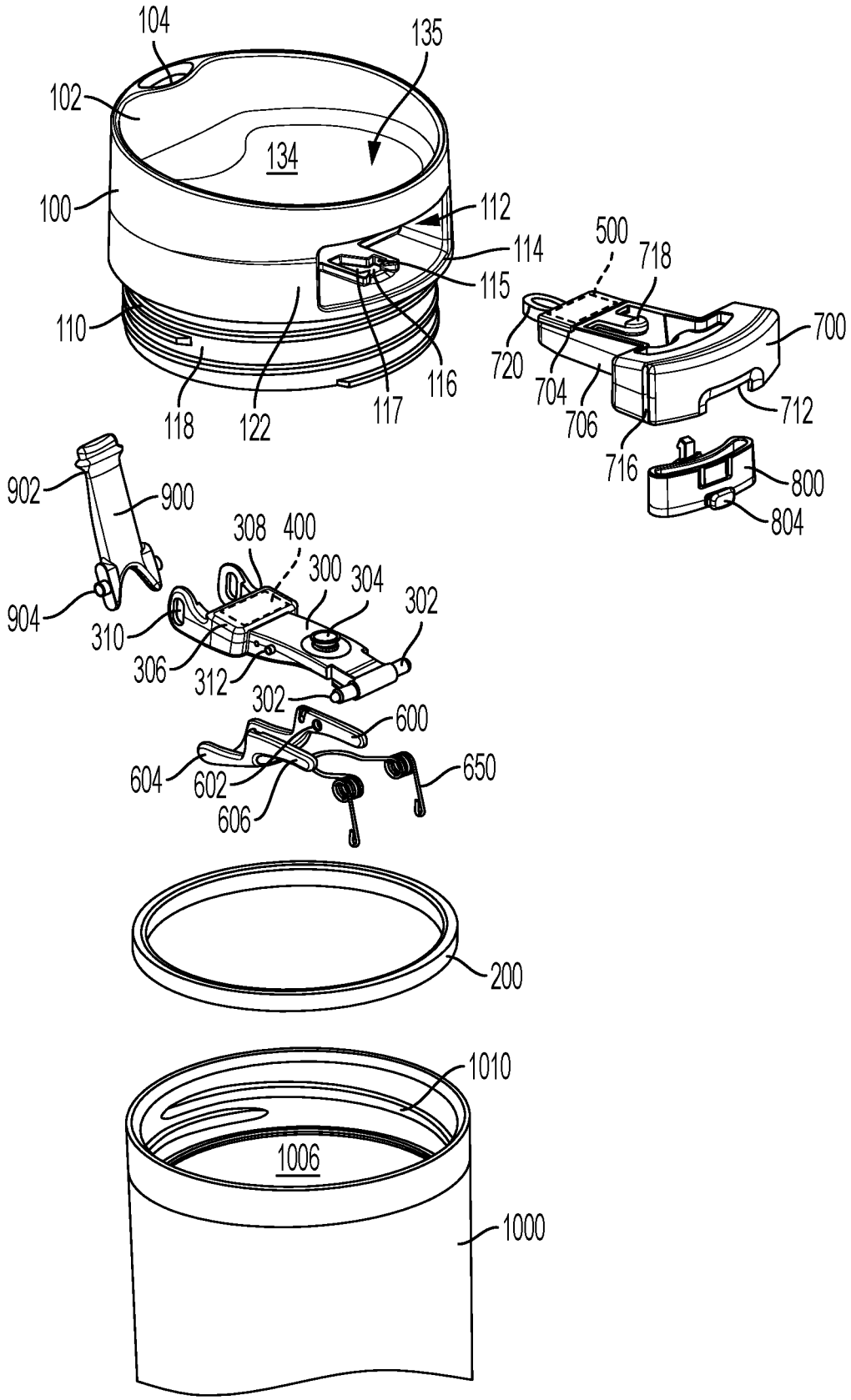
FIG. 3 shows an exploded upper rear perspective view of a portion of the container of FIG. 1.
Figure 4:
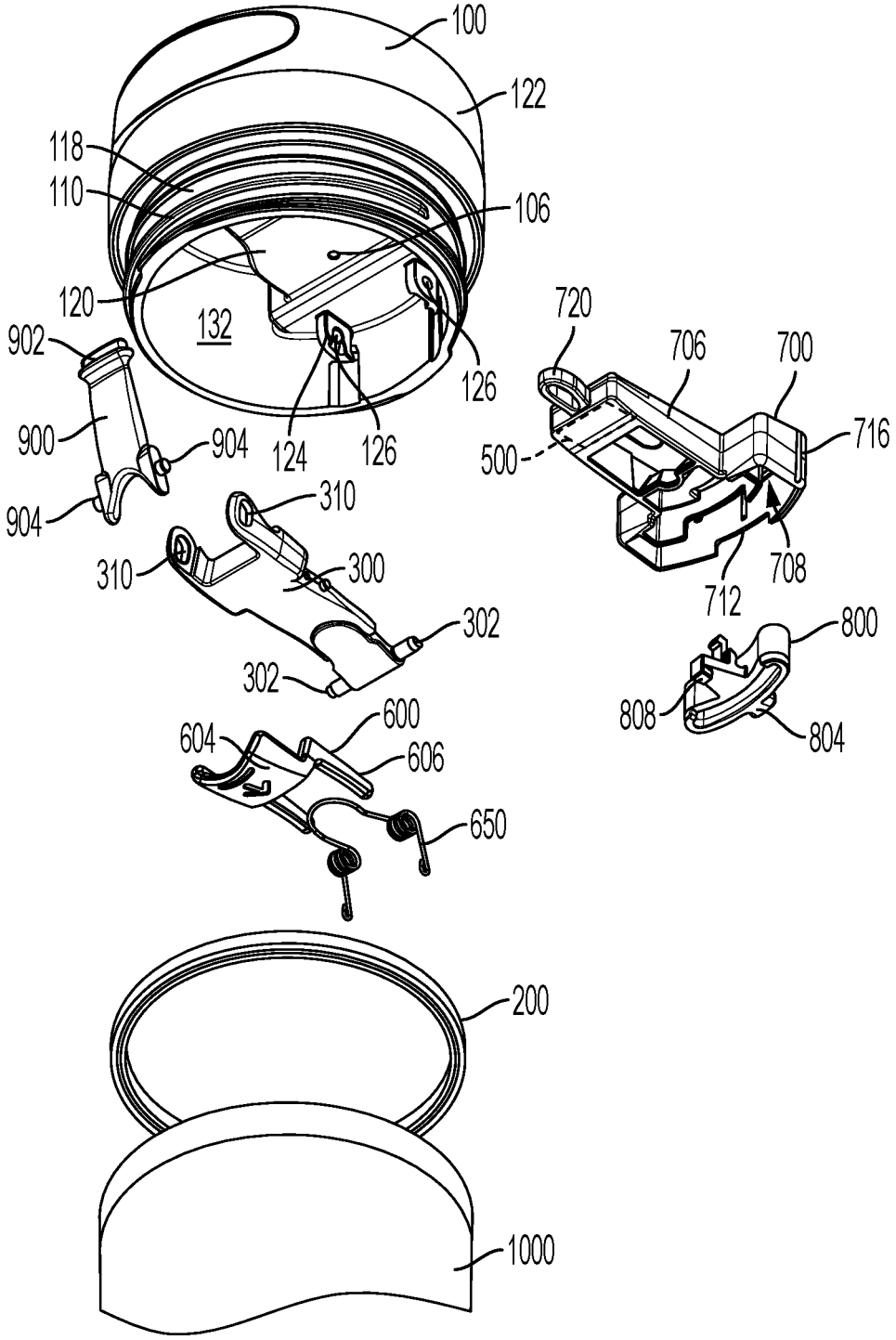
FIG. 4 shows an exploded lower front perspective view of a portion of the container of FIG. 1.

FIGS. 3 and 4 show exploded views of container 10 according to some embodiments. As shown, lid 20 includes lid body 100, actuator 700, a magnet unit 500, locking member 800, a lid sealing member 200, a movable arm 300, a magnet unit 400, a sealing arm 900, a cam 600, and a spring 650. Container 10 may also include vessel 1000.

Lid body 100 may define a spout 102 through which drinking opening 104 extends. Spout 102 may define one or more drinking openings 104. Lid body 100 may also define one or more venting openings 106. Venting opening 106 may extend between an interior 132 of lid body 100 and an atmosphere outside lid body 100, or between an interior 132 of lid body 100 and a portion of lid body 100 open to an atmosphere outside lid body 100.

Lid body 100 may define an actuator chamber 112. Actuator 700 may be positioned at least partially within actuator chamber 112 and may be accessible from the exterior of lid body 100. For example, as shown in FIG. 1, a portion of actuator 700 may protrude through an opening 114 in upper side wall 122 of lid body 100. Actuator 700 may be movable (e.g., slidable) within actuator chamber 112 between a first position and second position (e.g., by pressing and releasing actuator 700 as a button).

In some embodiments, actuator 700 may include a spring finger 718 in contact with a portion of lid body 100 when lid 20 is assembled. Spring finger 718 may help hold actuator 700 within actuator chamber 112 and/or reduce noise produced by lid 20 when actuator 700 moves with respect to lid body 100.

In some embodiments, actuator 700 is removable from actuator chamber 112. Actuator 700 may include, for example, a grip 716 to aid in removing actuator 700 from actuator chamber 112.

As shown, for example, in FIG. 3, actuator 700 may include a compartment 704 to receive magnet unit 500.

Magnet unit 500 may be or include one or more magnets with aligned poles that together function the same as a single magnet would. In some embodiments, magnet unit 500 includes an outer housing containing one or more magnets therein.

Compartment 704 may be spaced a distance away from a contact surface of actuator 700 (e.g., button 702) by a center portion 706 such that magnet unit 500 is spaced away from an outer edge of lid body 100 when lid 20 is assembled. In the illustrated embodiment, for example, magnet unit 500 is spaced away from a rear edge of lid body 100. In some embodiments, compartment 704 is spaced horizontally away from an outer edge (e.g., a rear edge) of lid body 100. In some embodiments, compartment 704 is spaced away from an outer edge (e.g., a rear edge) of lid body 100 in a direction of travel of actuator 700. In some embodiments, compartment 704 is spaced away from a rear edge of lid body 100 by more than half a diameter of lid body 100.

In some embodiments, magnet unit 500 is joined with actuator 700 with an adhesive. In some embodiments, magnet unit 500 is joined with actuator 700 by other chemical bonding (e.g., by welding, molding, or potting) and/or mechanical means (e.g., a press or snap fit).

Compartment 704 may be configured such that magnet unit 500 is at or near a lower surface of actuator 700 when magnet unit 500 is received in compartment 704. In this way, a magnetic field generated by magnet unit 500 will be relatively strong at a location just below the lower surface of actuator 700, compared to a magnetic field generated by magnet unit 500 if magnet unit 500 were positioned further above the lower surface of actuator 700.

Figure 9:
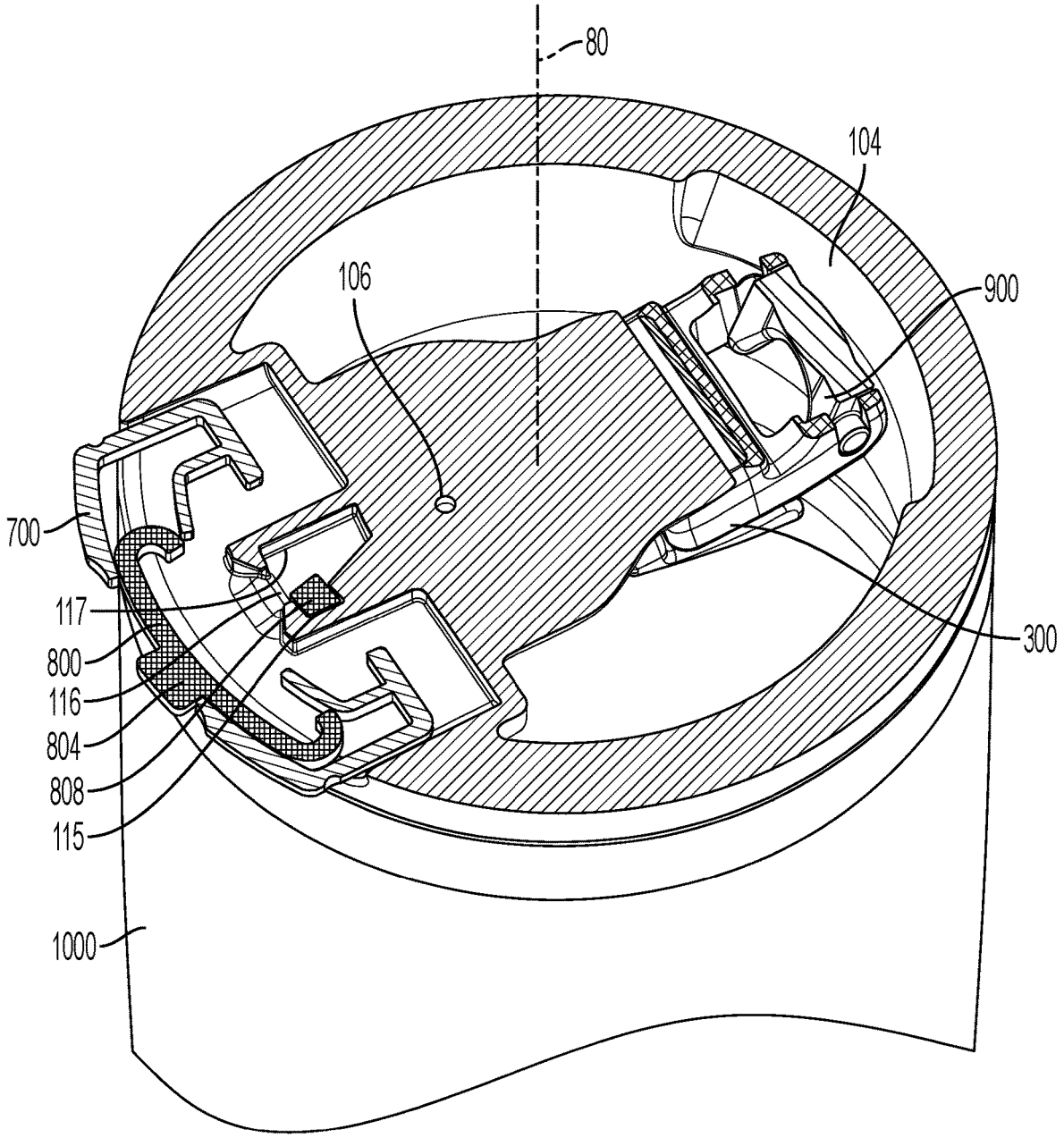
FIG. 9 shows a sectional view of a portion of the container of FIG. 1, with a locking member of the container in a locked position, taken at the position of line IX-IX' of FIG. 2.

As mentioned, in some embodiments lid body 100 includes locking member 800. Locking member 800 is optional; lid 20 need not include a lock in all embodiments. In some embodiments lid 20 does not include a lock. In embodiments that include locking member 800, actuator 700 may include a recess 708 for receiving locking member 800, and locking member 800 may be movable within recess 708 when lid 20 is assembled. In some embodiments, locking member 800 may be rotatable within recess 708 when lid 20 is assembled. For example, as shown in FIG. 9, locking member 800 may be rotatable about locking member axis 80. As shown, for example, in FIG. 1, when lid 20 is assembled, a portion of locking member 800 (e.g., nub 804) may protrude through an opening 712 in actuator 700 so that a user can engage locking member 800 from the exterior of lid 20. A user may move locking member 800 between positions (e.g., from a locked position to an unlocked position) by engaging nub 804 and sliding locking member 800 (e.g., in a clockwise direction about locking axis 80, viewed from the top of lid 20).

In some embodiments, locking member 800 is movable between three positions—a locked position, an unlocked position, and a disassembly position. As will be discussed in more detail below, when locking member 800 is in the locked position, actuator 700 is inhibited from moving from the first position to the second position. When locking member 800 is in the unlocked position, actuator 700 is free to move from the first position to the second position. When locking member 800 is in the disassembly position, actuator 700 can be removed from lid body 100 (e.g., by pulling actuator 700 out of actuator chamber 112). In some embodiments, locking member 800 is movable between only two positions, for example, the locked position and the unlocked position.

Lid body 100 may include attachment mechanism 110 on a lower side wall 118 of lid body 100. Vessel 1000 may include a corresponding attachment mechanism 1010 near an upper edge of the vessel, configured to engage with attachment mechanism 110 to removably attach vessel 1000 to lid 20. Attachment mechanisms 110 and 1010 may be threaded connectors (as shown in FIG. 3), friction fit connectors, snap-fit connectors, or any other suitable releasable attachment mechanism. The attachment of lid body 100 to vessel 1000 is not limited to the arrangement shown in the figures. For example, in some embodiments, lid body 100 may attach over vessel 1000 rather than inside vessel 1000.

When assembled with vessel 1000, lid sealing member 200 may be pressed between lid body 100 and an inner surface of vessel 1000, to create a seal between lid 20 and vessel 1000. Lid sealing member 200 may be a removable component (e.g., a removable gasket), or may be an integrally-formed part of lid body 100 or vessel 1000.

Moveable arm 300 may be positioned in interior 132 of lid body 100 and be movably coupled to lid body 100. In the illustrated embodiment, for example, movable arm 300 is coupled to lid body 100 through engagement of one or more receiving portions 126 of lid body 100 and one more engaging portions 302 of movable arm 300.

In some embodiments, movable arm 300 may be rotatable within lid body 100. For example, as shown in FIGS. 5-8, movable arm 300 may rotate about movable arm axis 30 extending through receiving portions 126 of lid body 100 and engaging portions 302 of movable arm 300.

In other embodiments, movable arm 300 is movable relative to lid body 100 in another manner such as, for example, by sliding. However, a rotatable movable arm may allow for a tighter seal of vent opening 106 or drinking opening 104 than a slidable movable arm 300. Movable arm 300 may be formed of food-grade material.

Moveable arm 300 may include a vent sealing portion 304. When lid 20 is assembled, vent sealing portion 304 may move with movable arm 300 such that vent sealing portion 304 seals venting opening 106 when moveable arm 300 is in certain positions.

In the illustrated embodiment, vent sealing portion 304 is formed as a diaphragm. However, vent sealing portion 304 may have any shape and configuration sufficient to seal vent opening 106. For example, in other embodiments, vent sealing portion 304 may be formed as a plug or gasket. Vent sealing portion 304 may be integrally formed as part of movable arm 300 (for example, through co-molding) or may be a separate component attached to movable arm 300. Vent sealing portion 304 may be formed of a food-grade material suitable to create a seal between lid body 100 and movable arm 300.

Figure 5:
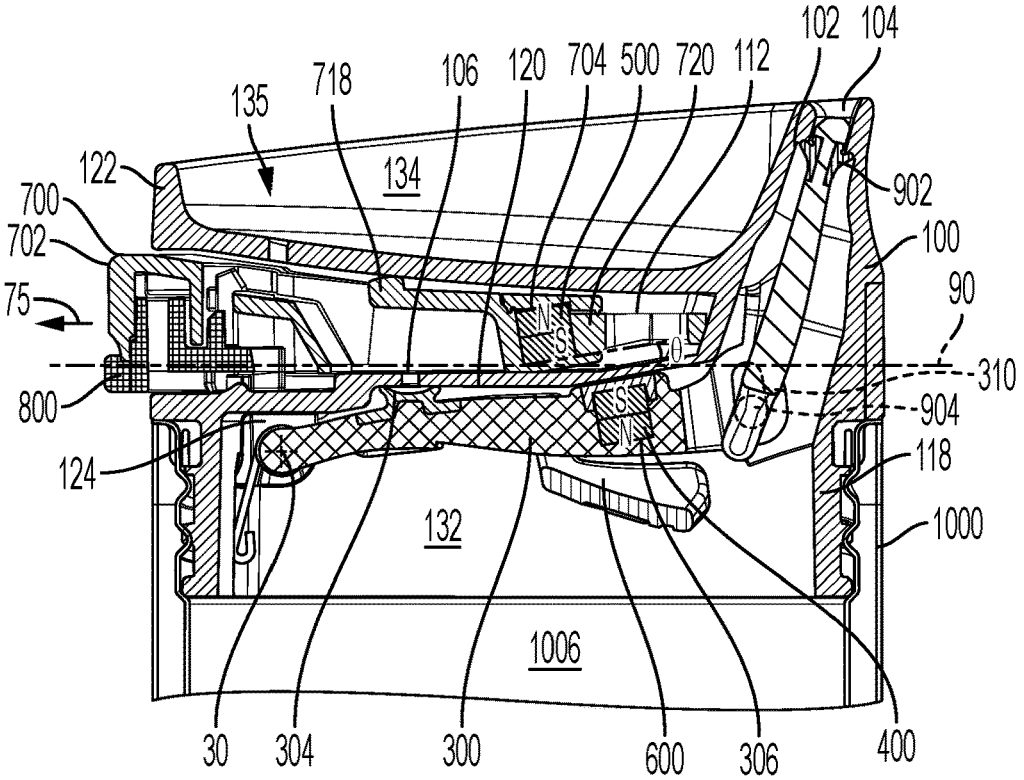
FIG. 5 shows a sectional view of a portion of the container of FIG. 1, with an actuator of the container in a first position and a movable arm of the container in a sealed position, taken at the position of line V-V' of FIG. 2.
Figure 6:
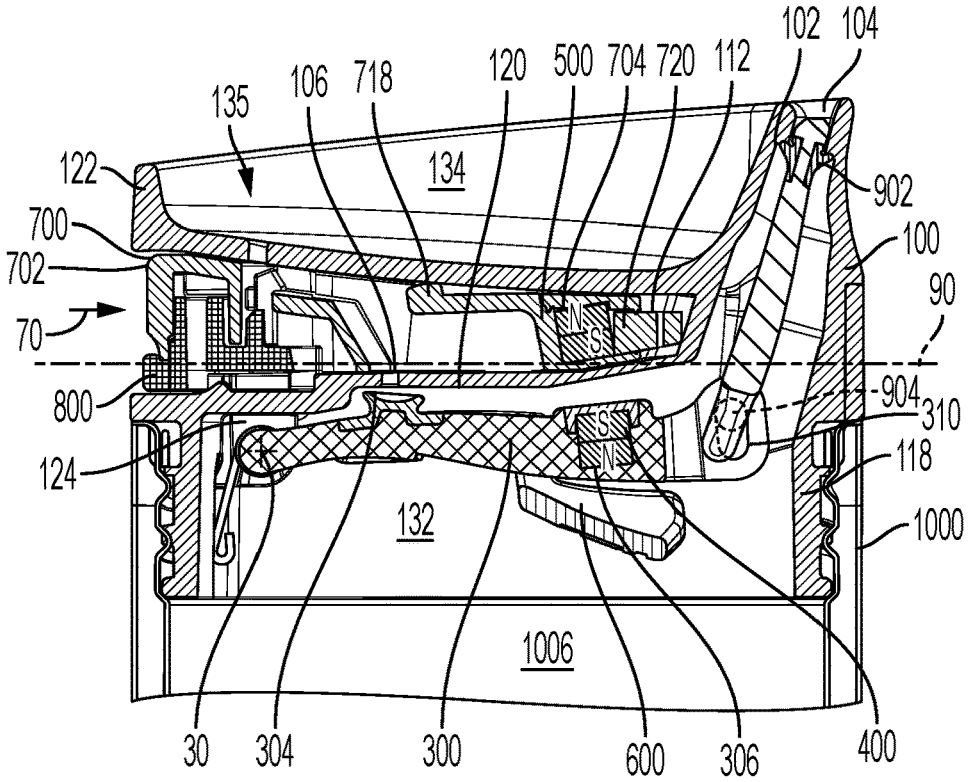
FIG. 6 shows a sectional view of a portion of the container of FIG. 1, with an actuator of the container in a second position and a movable arm of the container in a venting position, taken at the position of line V-V' of FIG. 2.
Figure 7:
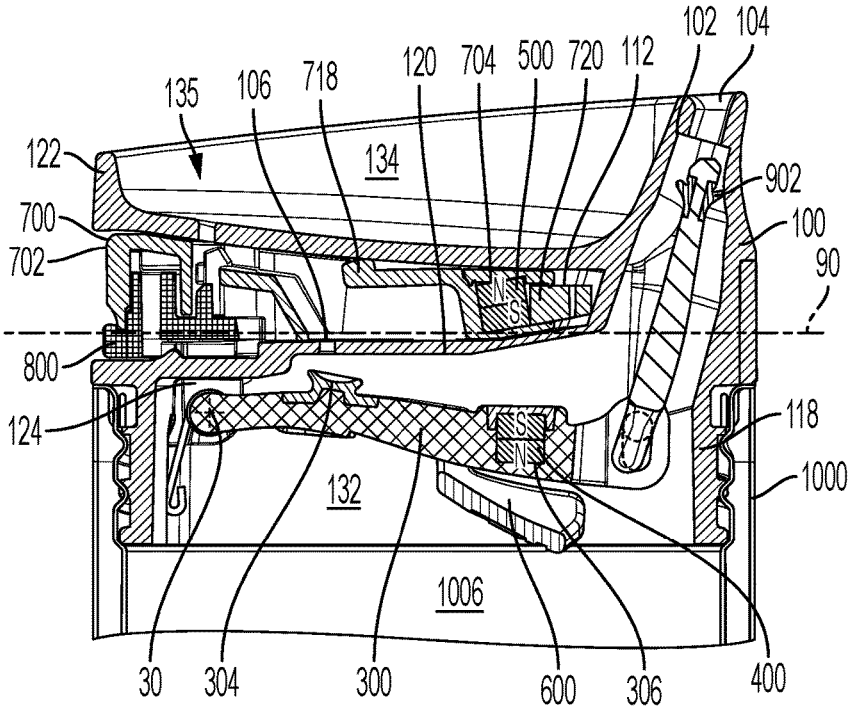
FIG. 7 shows a sectional view of a portion of the container of FIG. 1, with an actuator of the container in a second position and a movable arm of the container in an open position, taken at the position of line V-V' of FIG. 2.

Sealing arm 900 may be positioned in interior 132 of lid body 100 and be movably coupled to movable arm 300. In the illustrated embodiment, sealing arm 900 is coupled to movable arm 300 through engagement of one or more pins 904 of sealing arm 900 and one or more slots 310 of movable arm 300. In some embodiments, sealing arm 900 may be movable (e.g., pivotable, slidable, or a combination thereof) relative to movable arm 300. For example, as shown in FIGS. 5 and 6, pin 904 of sealing arm 900 may slide within slot 310 of movable arm 300, allowing sealing arm 900 to slide (e.g., generally upward or generally downward) relative to movable arm 300. As shown in FIGS. 6 and 7, pin 904 of sealing arm 900 may pivot within slot 310 of movable arm 300, allowing sealing arm 900 to pivot relative to movable arm 300. In some embodiments, pins 904 have a circular cross section and slots 310 have an elongated stadium shape. This may, for example, contribute to the ability of sealing arm 900 to slide and pivot relative to movable arm 300 as described above.

Sealing arm 900 may be movable between a sealing position, in which sealing arm 900 seals drinking opening 104, and an open position, in which sealing arm 900 does not seal drinking opening 104. In some embodiments, sealing arm 900 includes a drinking opening sealing portion 902 to seal drinking opening 104 when in the sealing position. As shown in FIG. 5, when lid 20 is assembled, sealing arm 900 may extend up into drinking opening 104 of lid body 100, which may, for example, be an elongated drinking opening 104, forming a passageway. Drinking opening sealing portion 902 may move with sealing arm 900 such that drinking opening sealing portion 902 seals drinking opening 104 when sealing arm 900 is in certain positions.

In the illustrated embodiment, drinking opening sealing portion 902 is formed as a diaphragm or flange forming a sealing surface around its periphery. However, drinking opening sealing portion 902 may have any shape and configuration sufficient to seal drinking opening 104. For example, in other embodiments, drinking opening sealing portion 902 may be formed as a plug, a diaphragm or a gasket. Drinking opening sealing portion 902 may be integrally formed as part of sealing arm 900 (for example, through co-molding) or may be or be a part of a separate component attached to sealing arm 900. Drinking opening sealing portion 902 may be formed of a food-grade material suitable to create a seal between lid body 100 and sealing arm 900.

Movable arm 300 may be moveable relative to lid body 100 between a sealed position (as shown in FIG. 5), a venting position (as shown in FIG. 6), and an open position (as shown in FIG. 7).

When movable arm 300 is in the sealed position (shown in FIG. 5), drinking opening 104 is sealed (e.g., by sealing arm 900 and drinking opening sealing portion 902). In some embodiments, drinking opening sealing portion 902 seals drinking opening 104 from below or presses against a surface of or around drinking opening 104 to seal drinking opening 104. In some embodiments, when movable arm 300 is in the sealed position, venting opening 106 is sealed (e.g., by movable arm 300 and venting opening sealing portion 304). For example, venting opening sealing portion 302 may press against a surface of or around venting opening 106, or plug venting opening 106 from below, to seal venting opening 106.

When movable arm 300 is in the venting position (shown in FIG. 6), venting opening 106 is not sealed. In some embodiments, when movable arm 300 is in the venting position, drinking opening 104 is sealed (e.g., by sealing arm 900 and drinking opening sealing portion 902).

When movable arm 300 is in an open position, drinking opening 104 is not sealed (e.g., so that a user may drink from container 10 through drinking opening 104). In some embodiments, when movable arm 300 is in the open position, venting opening 106 is not sealed.

In some embodiments, movable arm 300 is biased toward the sealed position. That is, in the absence of a mechanical force on a component of lid 20, movable arm 300 will return to (or remain in) the sealed position. In the illustrated embodiment, spring 650 (which may be, e.g., a torsion spring) biases movable arm 300 toward the sealed position. However, in other embodiments, movable arm 300 may be biased toward the sealed position by a magnetic force or a different physical component, e.g., a compression spring or elastic material that pushes movable arm 300 to the sealed position.

As shown, for example, in FIG. 3, movable arm 300 may include a compartment 306 for receiving magnet unit 400.

Magnet unit 400 may be or include one or more magnets with aligned poles that together function the same as a single magnet would. In some embodiments magnet unit 400 includes an outer housing containing one or more magnets therein.

Compartment 306 may be positioned in movable arm 300 such that magnet unit 400 is spaced away from an outer edge of lid 20 when lid 20 is assembled. Compartment 306 may be configured such that magnet unit 400 is positioned at or near an upper surface of movable arm 300 when magnet unit 400 is received in compartment 306. In this way, a magnetic field generated by magnet unit 400 will be relatively strong at a location just above moveable arm 300, compared to a magnetic field generated by magnet unit 400 if magnet unit 400 were positioned further below an upper surface of movable arm 300.

In some embodiments, magnet unit 400 is joined with movable arm 300 with an adhesive. In some embodiments, magnet unit 400 is joined with movable arm 300 by other chemical bonding (e.g., by welding, molding, or potting) and/or by mechanical means (e.g., a press fit). In some embodiments, movable arm 300 includes a magnet cover 308 to separate magnet unit 400 from interior 132 of lid body 100 when lid 20 is assembled. In some embodiments, magnet cover 308 is integrally formed with movable arm 300 (e.g., movable arm 300 may be molded in a first molding operation and magnet cover 308 may be formed in a second molding operation after magnet unit 400 is joined with movable arm 300).

Cam 600 may be positioned in interior 132 of lid body 100 and be movably coupled to movable arm 300. In the illustrated embodiment, for example, cam 600 is coupled to movable arm 300 through engagement of one or more receiving portions 602 of cam 600 and one more engaging portions 312 of movable arm 300. In some embodiments, cam 600 may be movable (e.g., pivotable) relative to movable arm 300.

As will be discussed in greater detail below, when actuator 700 moves between the first position and second position (e.g., when actuator 700 is pressed, as a button), magnet unit 500, which is located in compartment 704 of actuator 700, moves from a first position to a second position, thereby changing the magnetic field experienced by magnet unit 400. As a result, a magnetic force on magnet unit 400 causes movable arm 300, which is coupled to magnet unit 400, to move from a sealed position, in which drinking opening 104 is sealed, to a venting position, in which venting opening 106 is not sealed, or an open position, in which drinking opening 104 is not sealed. Similarly, when actuator 700 moves from the second position to the first position (e.g., when actuator 700 is released, as a button), magnet unit 500 moves from a second position to a first position, thereby changing the magnetic field experienced by magnet unit 400. As a result, a reduction in magnetic force on magnet unit 400 causes movable arm 300 to move from the venting position or the open position to the sealed position (e.g., due to biasing force applied by spring 650).

Movable arm 300 may not be mechanically linked to actuator 700. That is, moving actuator 700 (e.g., from the first position to the second position or vice versa) would not exert any mechanical force on movable arm 300 (only magnetic force, as described herein).

Movable arm 300, sealing arm 900, and cam 600 may all be positioned within container 10 when lid 20 is assembled. Thus, actuator 700 may be the only movable component of lid 20 accessible from an outside of container 10 when lid 20 is assembled.

Vessel 1000 may be any type of vessel. Vessel 1000 may be cylindrical or have another exterior or interior shape (as shown, for example, in FIGS. 1-2). In some embodiments, vessel 1000 may be double-walled to enhance thermal insulative properties of vessel 1000. In some embodiments, an area between vessel 1000's double walls may be hermetically sealed and may form at least a partial vacuum. In some embodiments, vessel 1000 may be formed of stainless steel. In some embodiments, vessel 1000 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

FIGS. 5-11 show detailed views of an embodiment for implementing some features as have been described. The specific structures and mechanisms shown and described (here and anywhere else in this document) may not be the only way to accomplish the functions described, and each element may be implemented using other shapes, structures, and appearances than specifically shown and described.

FIGS. 5-7 are cross-sectional views showing relative positions of certain components of lid 20 during operation. As mentioned above, during operation a user may move (e.g., slide) actuator 700 from a first position to a second position (e.g., by pressing actuator 700 like a button). FIG. 5 shows an assembled cross-sectional view of an upper portion of container 10 when actuator 700 is in the first position, and FIGS. 6 and 7 show assembled cross-sectional views of an upper portion of container 10 when actuator 700 is in the second position. The sections in FIGS. 5-7 are taken vertically at the position of line V-V' of FIG. 2.

As shown, for example, in FIG. 5, lid body 100 may include dividing wall 120. The illustrated dividing wall 120 curves upward toward the front of the lid body 100 to partially define spout 102. Spout 102 is located near the edge of lid body 100—offset from a center of lid body 100—so that it is in a comfortable location for a user when the user is drinking from the spout. As shown, drinking opening 104 may extend through spout 102. Drinking opening 104 may have a stadium-shaped cross section at an upper portion of spout 102. In some embodiments, the cross sectional shape of drinking opening 104 may change from an upper portion of drinking opening 104 to a lower portion of drinking opening 104.

Lid body 100 may include a lower side wall 118 extending downward from a lower side of dividing wall 120. Together, lower side wall 118 and dividing wall 120 may define an interior of 132 of lid body 100. When lid 20 is assembled with vessel 1000, interior 132 of lid body 100 may be in fluid communication with an interior 1006 of vessel 1000. Lid body 100 may also include an upper side wall 122 that extends upward from an upper side of dividing wall 120. In some embodiments, upper side wall 122 and dividing wall 120 may define a cavity 135. However, in other embodiments, lid body 100 does not include a cavity 135.

In some embodiments, drinking opening 104 extends from interior 132 of lid body 100, through dividing wall 120, and opens to atmosphere outside lid 20.

In some embodiments, vent opening 106 extends from interior 132 of lid body 100, through dividing wall 120, and opens to atmosphere. For example, in some embodiments, when vent opening 106 is not sealed, air from interior 132 of lid body 100 may pass through vent opening 106, through actuator chamber 112, and to an atmosphere outside lid 20. In other embodiments, when vent opening 106 is not sealed, air from interior 132 of lid body 100 may pass through vent opening 106, through a venting path provided in actuator 700, and to an exterior 134 of lid body 100 open to atmosphere.

Actuator 700 may extend within actuator chamber 112 from a rear of lid body 100 toward a front of lid body 100. Actuator 700 and actuator chamber 112 may be isolated from interior 132 of lid body 100 and drinking opening 104 such that a beverage carried inside vessel 1000 and/or consumed by a user through drinking opening 104 is not likely to contact actuator 700 or actuator chamber 112. This isolation may be desirable, for example, so that dirt or debris on actuator 700 or in actuator chamber 112 is not likely to contaminate a beverage within vessel 1000. The isolation may also be desirable so that, for example, actuator 700 is not likely to become soiled with deposits from a beverage carried within vessel 1000. In some embodiments, spring finger 718 of actuator 700 may contact a portion of lid body 100 defining actuator chamber 112 to help hold actuator 700 within actuator chamber 112 and/or reduce noise produced by lid 20 when actuator 700 moves with respect to lid body 100.

Movable arm 300 may extend from a rear of lid body 100 toward a front of lid body 100 in an interior of lid body 100. As discussed above with reference to FIG. 4, movable arm 300 may be movably coupled to lid body 100 such that movable arm 300 is rotatable about movable arm axis 30. For example, movable arm 300 may be movably coupled to lid body 100 at mounting portion 124 extending downward from dividing platform 120 of lid body 100. In the illustrated embodiment, mounting portion 124 includes receiving portions 126, and moveable arm 300 includes corresponding engaging portions 302. Engaging portions 302 of moveable arm 300 are received into receiving portions 126 of mounting portion 124, thereby allowing moveable arm 300 to rotate about movable arm axis 30. For example, moveable arm 300 may rotate from the sealed position (as shown, for example in FIG. 5) to the venting position (as shown, for example, in FIG. 6). In some embodiments, moveable arm 300 may move in a different manner. For example, moveable arm may move translationally forward and backward and/or up and down.

Sealing arm 900 may extend from movable arm 300 (e.g., from a front portion of movable arm 300) into drinking opening 104, which may be an elongated drinking opening 104 extending through spout 102. In embodiments in which sealing arm 900 extends into an elongated drinking opening 104 through spout 102, sealing arm 900 may seal drinking opening 104 inside spout 102 (e.g., at or near a top of drinking opening 104). This may, for example, help reduce the possibility that a liquid within drinking opening 104 but above the seal between drinking opening 104 and sealing arm 900 spills even when drinking opening 104 is sealed. As discussed above with reference to FIG. 4, sealing arm 900 may be movably coupled to movable arm 300 such that sealing arm 900 is pivotable, slidable, or both, relative to movable arm 300. For example, sealing arm 900 may be movably coupled to movable arm 300 through engagement of pins 904 and slots 310, which allow sealing arm 900 to pivot, slide, or both, relative to movable arm 300.

In some embodiments, moveable arm 300 can be moved (e.g., rotated) by applying a force (e.g., a magnetic force) to movable arm 300. As can be seen, for example, in FIGS. 5-7, application of a downward force to a front portion of movable arm 300 (relative to axis 30) may move movable arm 300 in a first rotational direction away from the sealed position, while application of an upward force to a front portion of moveable arm 300 (relative to axis 30) may move movable arm in a second rotational direction toward the sealed position.

When movable arm 300 is in the sealed position (shown in FIG. 5), drinking opening 104 is sealed (e.g., by sealing arm 900 and drinking opening sealing portion 902). In some embodiments, drinking opening sealing portion 902 seals drinking opening 104 from below or presses against a surface of or around drinking opening 104 to seal drinking opening 104. In some embodiments, when movable arm 300 is in the sealed position, venting opening 106 is sealed (e.g., by movable arm 300 and venting opening sealing portion 302). For example, venting opening sealing portion 302 may press against a surface of or around venting opening 106, or plug venting opening 106 from below, to seal venting opening 106.

Under some circumstances, pressure may build up inside container 10, for example when container 10 is used to carry a hot beverage. If the pressure inside container 10 is sufficiently high, the pressure may inhibit movable arm 300 from moving to its open position (for example by applying an upward force to a front portion of movable arm 300) or inhibit sealing arm 900 from moving to its open position.

To relieve the built-up pressure, movable arm 300 may be moved (e.g., rotated) to the venting position (shown in FIG. 6). Moving movable arm 300 to the venting position may require a smaller force than moving movable arm 300 to the open position. When movable arm 300 is in the venting position, venting opening 106 is not sealed. Thus, interior 132 of lid body 100 and interior 1006 of vessel 1000 may be in fluid communication with an atmosphere outside container 10, and pressure inside container 10 may be relieved through venting opening 106.

In some embodiments, when movable arm 300 is in the venting position, drinking opening 104 is sealed (e.g., by sealing arm 900 and drinking opening sealing portion 902). In some embodiments, the movable coupling between movable arm 300 and sealing arm 900 described above allows movable arm 300 to move to the venting position while drinking opening 104 remains sealed. This may, for example, help reduce the possibility of an undesirable pressure release through drinking opening 104. This may also, for example, allow movable arm 300 to be moved to the venting position with a smaller force than would be required if sealing arm 900 were also to move. As shown in FIGS. 5 and 6, when movable arm 300 moves from its closed position to its venting position, slot 310 of movable arm 300 may slide, pivot, or both, relative to pin 904 of sealing arm 900, thereby allowing sealing arm 900 to remain in its sealed position.

As pressure is relieved through venting opening 106, movable arm 300 may automatically move (e.g., further rotate) from its venting position to its open position (shown in FIG. 7). This may occur, for example, because as the pressure within container 10 is relieved, the upward force on the sealing arm 900 is reduced, which then balances with and is overcome by the downward force applied on the sealing arm pins 904 by the movable arm slots 310. The downward force is generated by the repelling force of magnet units 400 and 500. In this way, continued application of the repelling force of the magnets applied to movable arm 300 to move movable arm 300 to its venting position will cause movable arm 300 to move beyond the venting position to the open position.

In some embodiments, the movable coupling between movable arm 300 and sealing arm 900 described above moves sealing arm 900 away from its sealed position (e.g., to its open position) when movable arm 300 moves to its open position. For example, as shown in FIGS. 6 and 7, when movable arm 300 moves from its venting position to its open position, an upper portion of slot 310 of movable arm 300 engages an upper portion of pin 904 of sealing arm 900, thereby pulling sealing arm 900 away from its sealed position. Thus, when movable arm 300 is in an open position, drinking opening 104 is not sealed (e.g., so that a user may drink from container 10 through drinking opening 104).

As mentioned, in some embodiments, moveable arm 300 can be moved (e.g., rotated) by applying a force (e.g., a magnetic force) to movable arm 300. In some embodiments, interaction of magnet unit 500, positioned in compartment 704 of actuator 700, and magnet unit 400, positioned in compartment 306 of movable arm 300, create magnetic forces that move movable arm 300.

In the illustrated embodiment, magnet unit 500 is arranged such that a south pole of magnet unit 500 (labeled "S") is positioned at a bottom surface of actuator 700, and magnet unit 400 is arranged such that a south pole of magnet unit 400 (labeled "S") is positioned at a top surface of movable arm 300. However, each of the arrangements may be reversed to achieve a desired magnetic interaction. That is, magnet unit 500 can be arranged such that a north pole of magnet unit 500 is positioned at a bottom surface of actuator 700, and magnet unit 400 can be arranged such that a north pole of magnet unit 400 is positioned at a top surface of movable arm 300.

As shown, for example, in FIG. 5, when actuator 700 is in the first position, magnet unit 400 coupled to movable arm 300 may interact with magnet unit 500 coupled to actuator 700. For example, magnet unit 400 may be attracted to magnet unit 500. In the illustrated embodiment, magnet unit 400 and magnet unit 500 are arranged such that when actuator 700 is in the first position magnet unit 400 and magnet unit 500 are attracted. (For example, in the offset position of magnet unit 400 and magnet unit 500 shown, the attractive forces between the N side of magnet unit 500 and the S side of magnet unit 400 and between the S side of magnet unit 500 and the N side of magnet unit 400 are greater than the repulsive forces between the S side of magnet unit 500 and the S side of magnet unit 400 and between the N side of magnet unit 500 and the N side of magnet unit 400.) As a result, in this first position, magnet unit 500 applies an upward force on a front portion of movable arm 300, thereby pulling movable arm in a first rotational direction and maintaining movable arm 300 in the sealed position.

In some embodiments, movable arm 300 is also biased toward the sealed position. For example, in the illustrated embodiment, spring 650 (which may be, e.g., a torsion spring) pushes movable arm 300 in the first rotational direction, thereby holding movable arm 300 in the sealed position.

In FIG. 6, actuator 700 has been moved from the first position to the second position (e.g., by pushing button 702 toward the front of container 10). In some embodiments, actuator 700 slides linearly along a travel axis 90 when moving from the first position to the second position.

In FIG. 6, actuator 700 has moved a short distance between the first and second positions. However, actuator 700 may be configured to translate more or less than shown in the figures. As shown, for example, in FIG. 6, when actuator 700 is in the second position, magnet unit 400 coupled to movable arm 300 may interact with magnet unit 500 coupled to actuator 700. For example, magnet unit 400 may be repelled by magnet unit 500. In the illustrated embodiment, magnet unit 500 and magnet unit 400 are arranged such that a south pole of magnet unit 500 faces a south pole of magnet unit 400 when actuator 700 is in the second position. As a result, when actuator 700 is in the second position, magnet unit 500 applies a downward force on a front portion of movable arm 300, thereby pushing movable arm 300 in the second rotational direction toward the venting position or the open position. In embodiments in which movable arm 300 is biased toward the sealed position (e.g., by spring 650), the repulsive magnetic force between magnet unit 400 and magnet unit 500 may overcome the biasing force and cause movable arm 300 to move toward the venting position or the open position.

In some embodiments, in response to actuator 700 moving from the first position to the second position, the magnetic force between magnet unit 400 and magnet unit 500 moves movable arm 300 from the sealing position to the venting position and then to the open position. In some embodiments, actuator 700 remains in the second position while movable arm 300 moves from the venting position to the open position. As described above, this may occur, for example, because as the pressure within container 10 is relieved, the upward force on a front portion of movable arm 300 due to the pressure within container 10 lessens. As a result, continued application of the downward force applied to a front portion of movable arm 300 to move movable arm 300 to its venting position will cause movable arm 300 to move beyond the venting position to the open position.

In some embodiments, magnet unit 500 is angled relative to travel axis 90. In the illustrated embodiment, magnet unit 500 is angled approximately 10 degrees relative to travel axis 90. However, in other embodiments, magnet unit 500 is angled more or less than 10 degrees. For example, magnet unit 500 may be angled between −90 and 90 degrees (e.g., between 2 and 20 degrees (positive or negative) or between 5 and 15 degrees (positive or negative)) relative to travel axis 90.

In some embodiments in which magnet unit 500 is angled relative to travel axis 90, the magnetic force between magnet unit 500 and magnet unit 400 may take effect earlier in the travel of actuator 700 as actuator 700 is moved from the first position to the second position (relative to a lid in which magnet unit 500 is not angled). Thus, angling magnet unit 500 may allow for a weaker magnetic force between magnet unit 500 and magnet unit 400 when actuator 700 is in the first position, while achieving similar magnetic force between magnet unit 500 and magnet unit 400 when actuator 700 is in the second position. This may, in turn, contribute to a smoother transition of movable arm 300 from the sealed position to the venting position or open position.

In some embodiments, magnet unit 400 is angled relative to travel axis 90. In the illustrated embodiment, magnet unit 400 is angled approximately 10 degrees relative to travel axis 90. However, in other embodiments, magnet unit 400 is angled more or less than 10 degrees. For example, magnet unit 400 may be angled between −90 and 90 degrees (e.g., between 2 and 20 degrees (positive or negative) or between 5 and 15 degrees (positive or negative)) relative to travel axis 90.

In some embodiments in which magnet unit 400 is angled relative to travel axis 90, the magnetic force between magnet unit 500 and magnet unit 400 may increase more quickly as actuator 700 is moved from the first position to the second position (relative to a lid in which magnet unit 400 is not angled). Thus, angling magnet unit 400 may allow for a weaker magnetic force between magnet unit 500 and magnet unit 400 when actuator 700 is in the first position, while achieving the same magnetic force between magnet unit 500 and magnet unit 400 when actuator 700 is in the second position. This may, in turn, contribute to a smoother transition of movable arm 300 from the sealed position to the venting position or open position.

In some embodiments, magnet unit 400 and magnet unit 500 are both angled relative to travel axis 90. In some such embodiments, magnet unit 400 and magnet unit 500 are angled at the same angle relative to travel axis 90. For example, in some embodiments, magnet unit 400 and magnet unit 500 are angled between −90 and 90 degrees (e.g., between 2 and 20 degrees (positive or negative) or between 5 and 15 degrees (positive or negative)) relative to travel axis 90.

In some embodiments in which magnet unit 400 and magnet unit 500 are both angled relative to travel axis 90, the magnetic force between magnet unit 500 and magnet unit 400 may increase more quickly as actuator 700 is moved from the first position to the second position (relative to a lid in which magnet unit 400 and magnet unit 500 are not both angled). Thus, angling magnet unit 400 and magnet unit 500 may allow for a weaker magnetic force between magnet unit 500 and magnet unit 400 when actuator 700 is in the first position, while achieving the same magnetic force between magnet unit 500 and magnet unit 400 when actuator 700 is in the second position. This may, in turn, contribute to a smoother transition of movable arm 300 from the sealed position to the venting position or open position.

As illustrated, for example, in FIGS. 5-6, when a force (represented by arrow 70 in FIG. 6) is applied to actuator 700 in a direction generally toward the front of container 10, actuator 700 and coupled magnet unit 500 move toward a front of container 10. As magnet unit 500 moves toward a front of container 10, a magnetic force on magnet unit 400 changes. For example, in the illustrated embodiment, as magnet unit 500 moves toward the front of container 10, magnet unit 400 may experience an increasing repulsive force, thereby causing movable arm 300 to move in a second rotational direction toward the venting position or open position. The force represented by arrow 70 may, for example, be applied by a user pushing on a contact surface (e.g., button 702) of actuator 700.

In some embodiments, as illustrated, for example, in FIGS. 5-6, a biasing force may bias actuator 700 toward the first position (e.g., in the direction of arrow 75 in FIG. 5) such that actuator 700 automatically moves to the first position upon removal of a force holding actuator 700 in the second position (e.g., upon removal of a force applied by a user to button 702). In the illustrated embodiment, elastic tip 720 of actuator 700 biases actuator 700 toward the first position (e.g., by compressing against a wall of actuator chamber 112 when actuator 700 is in the second position). However, in other embodiments, actuator 700 may be biased toward the first position by a magnetic force or a different physical component, e.g., a compression spring or elastic material that pushes actuator 700 to the first position.

In some embodiments, a user may apply a force to a portion of actuator 700 to move (e.g., translate) actuator 700. Generally, the force applied by a user may overcome the biasing force (e.g., a force applied by a user to move actuator 700 from the first position to the second position may overcome a biasing force biasing actuator 700 toward the first position).

As mentioned, in some embodiments, a biasing force may move actuator 700 from the second position to the first position (e.g., in the direction of arrow 75 generally toward the rear of container 10). In other embodiments, a user-applied force may move actuator 700 from the second position to the first position (e.g., in the direction of arrow 75 generally toward the rear of container 10). As illustrated, for example, in FIGS. 5-6, when actuator 700 moves in a direction generally toward the rear of container 10, actuator 700 and coupled magnet unit 500 move toward a rear of container 10. As magnet unit 500 moves toward a rear of container 10, a magnetic force on magnet unit 400 changes. For example, in the illustrated embodiment, as magnet unit 500 moves toward the rear of container 10, magnet unit 400 may experience an increasing attractive force (or a decreasing repulsive force), thereby causing movable arm 300 to move in a first rotational direction toward the sealed position. In embodiments in which movable arm 300 is biased toward the sealed position (e.g., by spring 650), when actuator 700 is moved from the second position to the first position, the biasing force may also cause movable arm 300 to move in a first rotational direction toward the sealed position.

In some embodiments, movable arm 300 is biased toward the sealed position. That is, in the absence of a mechanical force on a component of lid 20, movable arm 300 will return to (or remain in) the sealed position. In the illustrated embodiment, spring 650 (which may be, e.g., a torsion spring) biases movable arm 300 toward the sealed position. However, in other embodiments, movable arm 300 may be biased toward the sealed position by a magnetic force or a different physical component, e.g., a compression spring or elastic material that pushes movable arm 300 to the sealed position.

In embodiments in which movable arm 300 is biased toward the sealed position, moving actuator 700 may cause a magnetic interaction that overcomes the bias. For example, in the illustrated embodiment, when movable arm 300 is in the sealed position, moving actuator 700 from the first position to the second position causes magnet unit 500 to interact with magnet unit 400, as discussed above, such that the bias of movable arm 300 may be overcome and movable arm 300 moves to the open position.

As shown and described, one benefit of lid 20 is that its mechanisms for sealing and unsealing its drinking opening 104 do not extend through a wall of lid 20. This eliminates the need for an opening to accommodate a mechanism through a wall of lid 20, which can provide an additional point of failure for leaks. To this end, drinking opening sealing portion 902 is positioned within an interior of lid 20 (and thus within a container of which lid 20 is a part) and movable within lid 20 between a sealing position in which it seals drinking opening 104 (shown in FIG. 5) and a non-sealing position in which it does not seal drinking opening 104 (shown in FIG. 6). So sealing portion 902 (and associated sealing arm 900, movable arm 300, and cam 600) stay within and do not extend through any wall of lid 20 while sealing portion 902 moves between the sealing position and the non-sealing position.

Relatedly, actuator 700 is disposed and accessible from an exterior of lid 20, and does not extend through any wall of lid 20. Yet when actuator 700 is actuated by a user as described, it causes sealing portion 902 to move from the sealing position to the non-sealing position, and in doing so it does not cause movement of any element of lid 20 through a wall of lid 20. This configuration, whereby an interior seal can be sealed and un-sealed by an external actuator without any mechanism extending through a wall of lid 20 to do so helps eliminate the need for an opening through a wall of lid 20, thereby reducing he potential for leaks.

Figure 8:
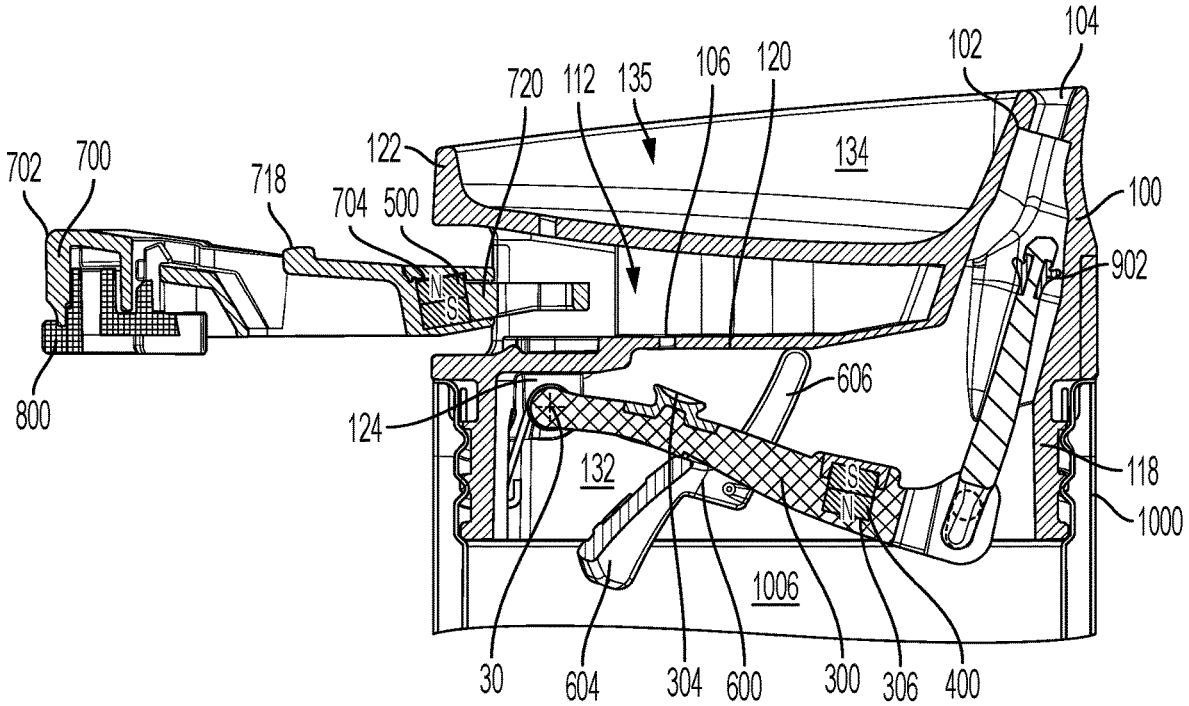
FIG. 8 shows a sectional view of a portion of the container of FIG. 1, with an actuator of the container removed and with a movable arm of the container in a washing position, taken at the position of line V-V' of FIG. 2.

As discussed previously, a user may sometimes want to wash lid 20. In such a situation, a user may be able to place lid 20 in a washing configuration in which movable arm 300 and vent seal 304 are held away from dividing platform 120, and/or in which sealing arm 900 and drink sealing member 902 do not seal drinking opening 104. This washing configuration is shown in FIG. 8. The sections in FIG. 8 is taken vertically at the position of line V-V' of FIG. 2.

To place lid 20 in the washing configuration, a user may grasp a grip 604 of cam 600 and rotates cam 600 relative to movable arm 300. As cam 600 is rotated relative to movable arm 300, arm 606 of cam 600 may encounter a portion of lid body 100 (e.g., dividing platform 120). The interaction of arm 606 of cam 600 and lid body 100 may apply a downward force on a front portion of movable arm 300, thereby pushing movable arm in the second rotational direction and rotating movable arm 300 in a washing position. Cam 600 may be held in this configuration by the biasing force applied to movable arm 300 by spring 650, such that in order to move cam 600 back toward the position shown in FIG. 7, a force overcoming that biasing force must be applied (e.g., due to a user intentionally moving cam 600).

When movable arm 300 is in the washing position, sealing arm 900 may not seal drinking open 104 and may be free to move within drinking opening 104.

In some embodiments, lid 20 does not have a washing configuration, in which case cam 600 is not included in lid 20.

As discussed previously, a user may sometimes want container 10 to stay sealed. For example, a user may want container 10 to stay sealed so that a beverage being carried inside container 10 will not leak on a user or a user's belongings when container 10 is placed in the user's backpack or other bag (where container 10 may encounter forces from other items in the user's bag, or may change orientation). In such a situation (as in others), a user may be able to place container 10 in a locked configuration in which actuator 700 is inhibited from moving to the second position, thereby inhibiting actuator 700 from causing movable arm 300 to rotate to the open position. This locked configuration is shown in FIG. 9 and described in more detail below.

Figure 10:
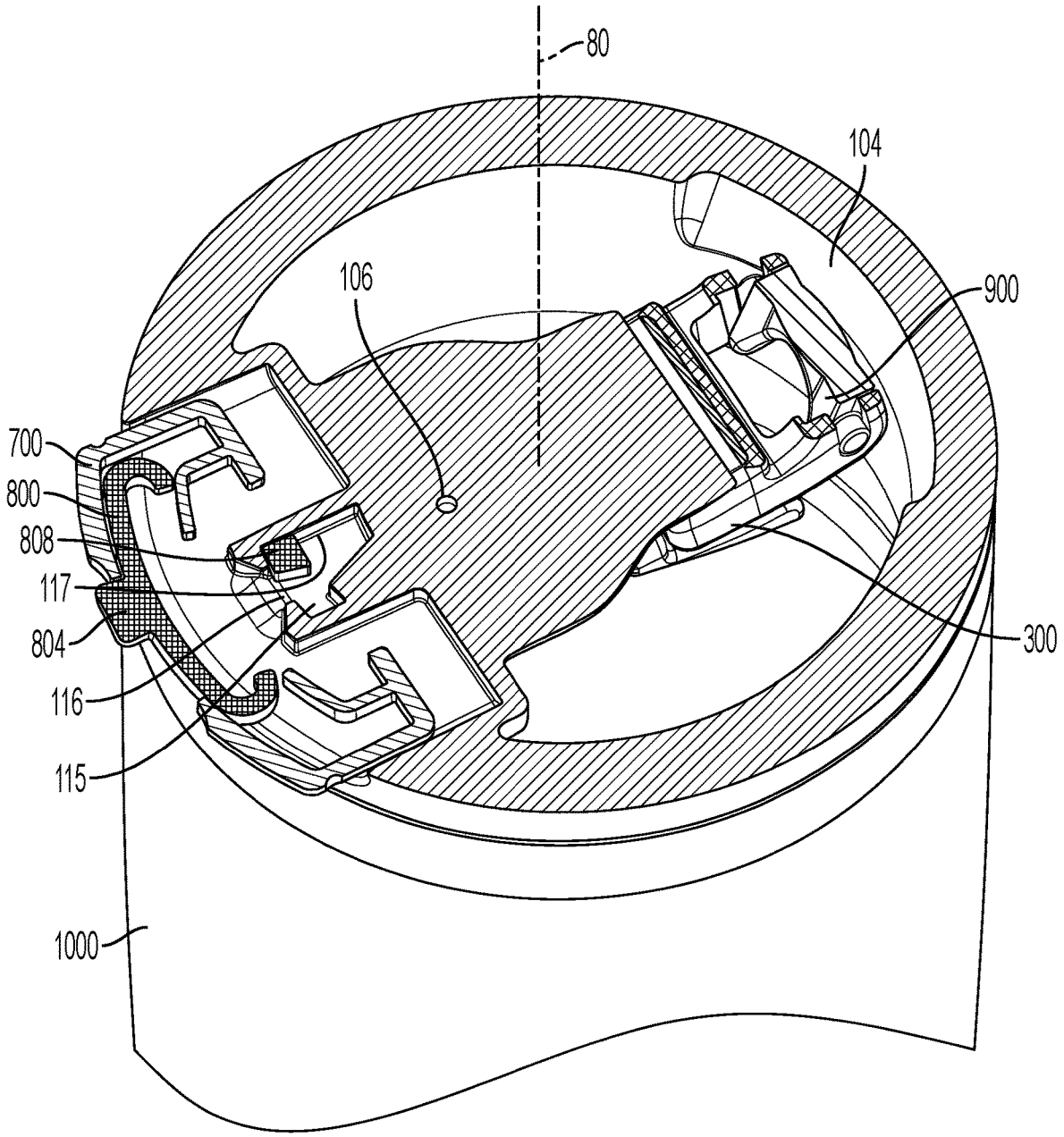
FIG. 10 shows a sectional view of a portion of the container of FIG. 1, with a locking member of the container in an unlocked position, taken at the position of line IX-IX' of FIG. 2.
Figure 11:
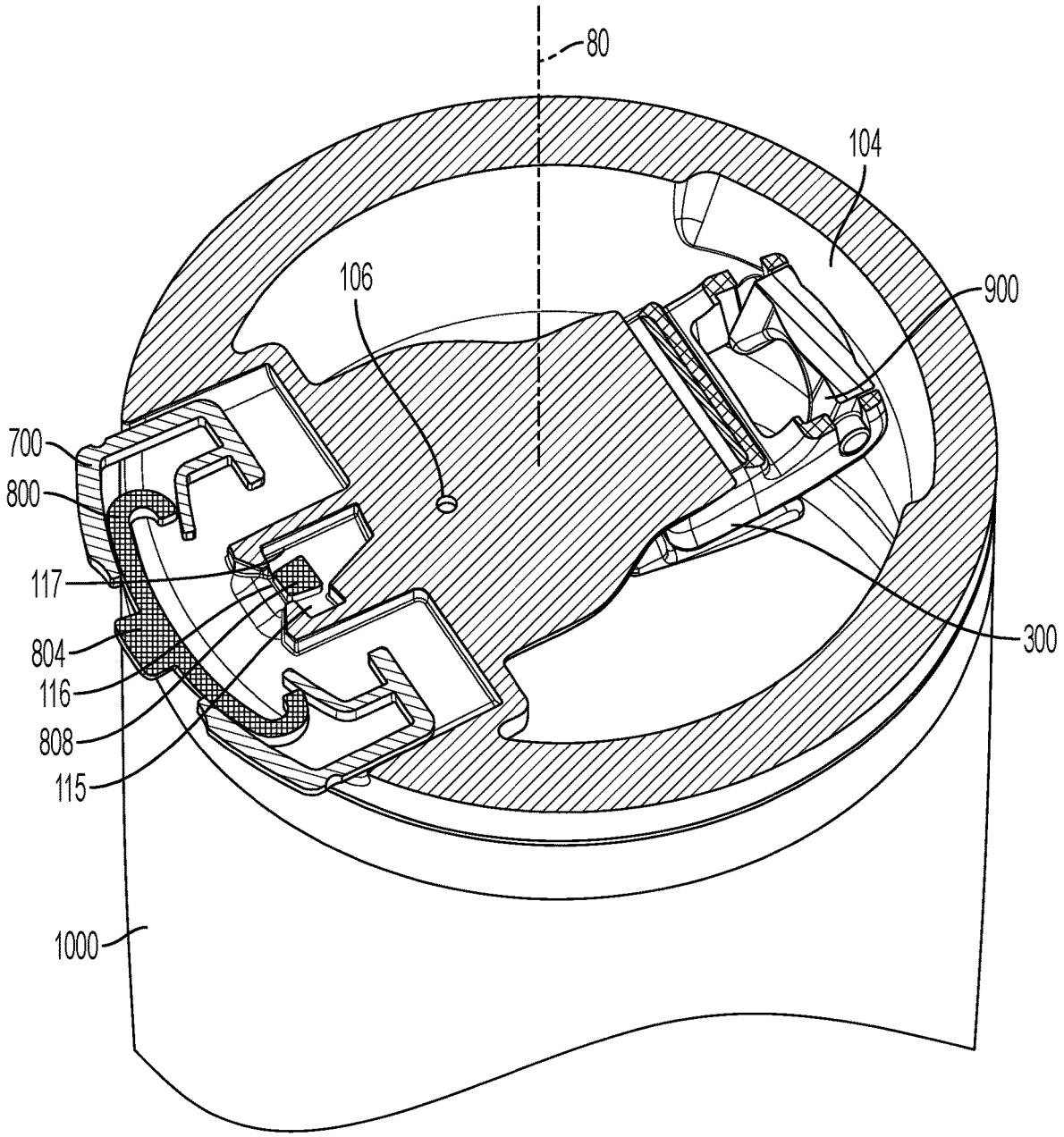
FIG. 11 shows a sectional view of a portion of the container of FIG. 1, with a locking member of the container in a disassembly position, taken at the position of line IX-IX' of FIG. 2.

FIGS. 9-11 show relative positions of portions of lid body 100, actuator 700, locking member 800, and other components of lid 20 when lid 20 is in three operational states: a locked configuration with actuator 700 in the first position (FIG. 9), an unlocked configuration with actuator 700 in the first position (FIG. 10), and a disassembly configuration with actuator 700 in the first position (FIG. 11). The sections in FIGS. 9-11 are taken horizontally at the position of line IX-IX' of FIG. 2 offset from the top of lid 20.

As discussed, lid body 100 may define an actuator chamber 112 into which actuator 700 and locking member 800 are positioned. As shown, for example, in FIG. 4, locking member 800 may have a post 808 extending from a lower portion of locking member 800. As shown, for example, in FIG. 3, a bottom portion of actuator chamber 112 may include a recess 117, a compartment 115, and a channel 116.

When lid 20 is in the locked configuration, for example, as shown in FIG. 9, post 808 is received in compartment 115. When a force is applied to actuator 700 in a direction generally toward the front of container 10, compartment 115 interferes with post 808, thereby inhibiting actuator 700 from moving to the second position.

When lid 20 is in the disassembly configuration, for example, as shown in FIG. 11, post 808 is received in recess 117 and is aligned with channel 116. When a force is applied to actuator 700 in a direction generally toward the rear of container 10, post 808 slides through channel 116 and out of actuator chamber 112. As a result, locking member 800 and actuator 700 can be removed from actuator chamber 112 of lid body 100. Removing actuator 700 and locking member 800 from lid body 100 may be desirable, for example, so that a user may thoroughly clean container 10.

When actuator 700 is replaced within lid body 100, it will initially be in the disassembly configuration shown in FIG. 11. However, as a user presses actuator 700 (e.g., as part of an assembly operation or as part of opening drinking opening 104 as described above, post 808 will ride along an angled wall of recess 117 to transition to the unlocked configuration such that when actuator 700 is released, post 808 will be in the unlocked configuration shown in FIG. 10. This can help keep lid 20 from being accidentally left in the disassembly configuration and ensures that even if the user does not remember to move the lock from disassembly position when assembling they will not risk actuator 700 falling out once they have pressed actuator 700 once.

When lid 20 is in the unlocked configuration, for example, as shown in FIG. 10, post 808 is received in recess 117. When a force is applied to button 702 in a direction generally toward the front of container 10, post 808 generally does not interfere with edges of recess 117. Accordingly, actuator 700 can be moved from the first position to the second position.

Locking member 800 may be movable from each of its three positions—unlocked position, locked position, and disassembly position—to each of its other positions, for example, by engaging a portion of locking member 800 (e.g., nub 804) and sliding locking member (e.g., in a clockwise or counterclockwise direction about a locking axis 80). In the illustrated embodiment, lid 20 is in the locked position when locking member 800 is in the counterclockwise-most position, viewed from the top of lid 20, relative to actuator 700, lid 20 is in unlocked position when locking member 800 is in the clockwise-most position, viewed from the top of lid 20, relative to actuator 700, and lid 20 is in a disassembly position when locking member 800 is in an intermediate position relative to actuator 700. However, the unlocked position, locked position, and disassembly position may be provided at different relative positions of locking member 800 and actuator 700.

It is to be appreciated that the Detailed Description section, and not the Summary and Abstract sections, is intended to be used to interpret the claims. The Summary and Abstract sections may set forth one or more but not all exemplary embodiments of the disclosed invention(s) as contemplated by the inventor(s), and thus, are not intended to limit the disclosed invention(s) and the appended claims in any way.

The foregoing description of the specific embodiments will so fully reveal the general nature of the claimed invention that others can, by applying knowledge within the skill of the art, readily modify and/or adapt for various applications such specific embodiments, without undue experimentation, without departing from the general concept of the claimed invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the claimed invention should not be limited by any of the above-described exemplary embodiments, but should be defined only in accordance with the claims and their equivalents.

What is claimed is:

1. A lid for a container, the lid comprising:

a lid body defining a drinking opening therethrough;

a movable arm coupled to the lid body and located in an interior of the lid body, a sealing arm movably coupled to the movable arm, wherein the movable arm is movable between a sealing position, in which the sealing arm seals the drinking opening, and an open position, in which the drinking opening is not sealed;

a first magnet unit coupled to the movable arm;

an actuator accessible from an exterior of the lid body, the actuator movable between a first position and a second position; and a second magnet unit coupled to the actuator, wherein when the actuator is in the first position, at least one of a biasing force and an attractive magnetic force between the first magnet unit and the second magnet unit hold the movable arm in the sealing position, and wherein when the actuator is moved toward the second position, a repulsive magnetic force between the first magnet unit and the second magnet unit causes the movable arm to move toward the open position.

2. The lid of claim 1, wherein the lid body defines a vent opening, and wherein the drinking opening and the vent opening are the only openings through the lid body.

3. The lid of claim 1, where no mechanism for sealing or unsealing the drinking opening penetrates the lid body.

4. The lid of claim 1, wherein the movable arm is biased toward the sealing position by the biasing force, and wherein a spring provides the biasing force.

5. The lid of claim 1, wherein the actuator automatically moves from the second position to the first position upon removal of a force holding the actuator in the second position.

6. The lid of claim 1, wherein when the actuator is moved from the second position to the first position, the repulsive magnetic force between the first magnet unit and the second magnet unit is reduced, and the movable arm returns to the sealing position.

7. The lid of claim 1, wherein the movable arm pivots about a rotation axis when moving from the sealing position to the open position.

8. The lid of claim 7, wherein the first magnet unit and the second magnet unit are both located to the same side of a vertical plane passing through the rotation axis of the movable arm.

9. The lid of claim 1, wherein the lid body defines a venting opening therethrough, wherein when the movable arm is in the sealing position, the venting opening and the drinking opening are sealed, wherein when the movable arm is in the venting position, the venting opening is not sealed and the drinking opening is sealed, and wherein when the movable arm is in the open position, the venting opening and the drinking opening are not sealed.

10. The lid of claim 1, wherein the actuator linearly slides along a travel axis to move between the first position and the second position, and wherein one of the first magnet unit or the second magnet unit is angled relative to the travel axis.

11. The lid of claim 10, wherein both the first magnet unit and the second magnet unit are angled relative to the travel axis.

12. The lid of claim 11, wherein the one of the first magnet unit or the second magnet unit is angled between 2 and 20 degrees relative to the travel axis.

13. A container comprising:

the lid of claim 1; and a vessel, wherein the lid is configured to attach to the vessel to close an interior volume of the vessel.

14. The lid of claim 1, wherein the sealing arm is pivotable and slidable relative to the movable arm.

15. A lid for a container, the lid comprising:

a lid body defining a drinking opening and a venting opening therethrough;

a movable arm coupled to the lid body and located in an interior of the lid body, the movable arm movable between a sealing position, a venting position, and an open position;

a first magnet unit coupled to the movable arm;

an actuator accessible from an exterior of the lid body, the actuator movable between a first position and a second position; and a second magnet unit coupled to the actuator, wherein when the movable arm is in the sealing position, the venting opening and the drinking opening are sealed, wherein when the movable arm is in the venting position, the venting opening is not sealed and the drinking opening is sealed, wherein when the movable arm is in the open position, the venting opening and the drinking opening are not sealed, and wherein in response to the actuator moving from the first position to the second position, a magnetic force between the first magnet unit and the second magnet unit moves the movable arm from the sealing position to the venting position and then to the open position.

16. The lid of claim 15, wherein the actuator remains in the second position while the movable arm moves from the venting position to the open position.

17. The lid of claim 15, further comprising a sealing arm movably coupled to the movable arm and movable between a sealing position, in which the sealing arm seals the drinking opening, and an open position, in which the sealing arm does not seal the drinking opening.

18. The lid of claim 17, wherein:

when the movable arm is in the sealing position, the movable arm seals the venting opening and the sealing arm seals the drinking opening, and when the movable arm is in the venting position, the sealing arm seals the drinking opening.

19. The lid of claim 17, wherein in response to the movable arm moving to its open position, the sealing arm moves to its open position.

20. The lid of claim 17, wherein the movable arm defines a slot, and the sealing arm comprises a pin slidable within the slot of the movable arm.

21. The lid of claim 20, wherein the pin of the sealing arm pivots within the slot when the movable arm moves from the venting position to its open position, and wherein the pin of the sealing arm slides within the slot when the movable arm moves from its sealing position to the venting position.

22. The lid of claim 17, further comprising a drinking spout in fluid communication with the drinking opening, wherein the sealing arm seals the drinking opening inside the drinking spout.

23. The lid of claim 15, wherein the actuator linearly slides along a travel axis to move between the first position and the second position, and wherein one of the first magnet unit or the second magnet unit is angled relative to the travel axis.

24. A container comprising:

the lid of claim 15; and a vessel, wherein the lid is configured to attach to the vessel to close an interior volume of the vessel.

25. A lid for a container, the lid comprising:

a lid body defining a drinking opening therethrough;

a movable arm coupled to the lid body and located in an interior of the lid body, the movable arm movable between a sealing position, in which the drinking opening is sealed, and an open position, in which the drinking opening is not sealed;

a first magnet unit coupled to the movable arm;

an actuator accessible from an exterior of the lid body, the actuator linearly slidable along a travel axis from a first position to a second position; and a second magnet unit coupled to the actuator, wherein when the actuator is moved toward the second position, a force between the first magnet unit and the second magnet unit causes the movable arm to move away from the sealing position, and wherein at least one of the first magnet unit and the second magnet unit is angled at an oblique angle relative to the travel axis when the movable arm is in the sealing position.

26. The lid of claim 25, wherein both the first magnet unit and the second magnet unit are angled relative to the travel axis when the movable arm is in the sealing position.

27. The lid of claim 25, wherein the first magnet unit is angled at a first angle relative to the travel axis when the movable arm is in the sealing position, wherein the second magnet unit is angled at a second angle relative to the travel axis when the movable arm is in the sealing position, and wherein the first angle is equal to the second angle.

28. The lid of claim 25, wherein the one of the first magnet unit or the second magnet unit is angled between 2 and 20 degrees relative to the travel axis when the movable arm is in the sealing position.

29. The lid of claim 25, wherein the movable arm is biased toward the sealing position, and wherein when the actuator is moved toward the second position, the force between the first magnet unit and the second magnet unit overcomes the bias of the movable arm.

30. A container comprising:

the lid of claim 25; and a vessel, wherein the lid is configured to attach to the vessel to close an interior volume of the vessel.

* * * * *